US006910553B1

(12) United States Patent
Löbbe et al.

(10) Patent No.: US 6,910,553 B1
(45) **Date of Patent: *Jun. 28, 2005**

(54) BUILDING ELEVATOR

(75) Inventors: Hartmut Löbbe, Bönen (DE); Frank Kolkmann, Kamen (DE)

(73) Assignee: Herman Steinweg GmbH Co. & KG Baumaschinenfabrik, Werne (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/634,091

(22) Filed: Aug. 7, 2000

Related U.S. Application Data

(63) Continuation of application No. PCT/EP99/00534, filed on Jan. 27, 1999.

(30) Foreign Application Priority Data

Feb. 7, 1998 (DE) ..... 298 02 090 U

(51) Int. Cl.[7] ..... B66B 5/14
(52) U.S. Cl. ..... 187/281; 187/289
(58) Field of Search ..... 187/281, 289, 187/287, 250, 276, 277, 256, 258; 361/23, 31; 312/434, 34, 49, 101, 103, 104, 625

(56) References Cited

U.S. PATENT DOCUMENTS

| | | | | |
|---|---|---|---|---|
| 4,304,337 A | * | 12/1981 | Dummer | 212/191 |
| 4,698,565 A | * | 10/1987 | Behnke et al. | 318/434 |
| 4,919,236 A | * | 4/1990 | Karlsson et al. | 187/25 |
| 4,953,053 A | * | 8/1990 | Pratt | 361/31 |
| 5,329,468 A | * | 7/1994 | Tsukahara et al. | 318/603 |
| 5,352,965 A | * | 10/1994 | Kawabata | 318/807 |
| 5,422,550 A | * | 6/1995 | McClanahan et al. | 318/91 |
| 5,428,470 A | * | 6/1995 | Labriola | 422/62 |
| 5,555,952 A | * | 9/1996 | van Mol et al. | 182/18 |
| 5,638,387 A | * | 6/1997 | Palleggi | 318/67 |

* cited by examiner

*Primary Examiner*—Jonathan Salata
(74) *Attorney, Agent, or Firm*—Katten Muchin Zavis Rosenman

(57) ABSTRACT

A building elevator with an elevator mast and an elevator car with at least one electric drive motor for the elevator car for moving the same along the elevator mast. A novel overload-prevention device for the building elevator has two drive motors with the device intended for adding the forces occurring in the abutments of the drive motors and connected to a limit switch.

3 Claims, 2 Drawing Sheets

BUILDING ELEVATOR

This application is a continuation of international application number PCT/EP99/00534, filed Jan. 27, 1999, (pending).

CROSS REFERENCE TO RELATED APPLICATIONS

Not applicable.

STATEMENT RE: FEDERALLY SPONSORED RESEARCH AND DEVELOPMENT

Not applicable.

REFERENCE TO "MICROFICHE APPENDIX"

Not applicable.

BACKGROUND OF THE INVENTION

1. Field of the Invention

The invention relates to a building elevator with an elevator mast and an elevator car and with at least one electric drive motor for the elevator car, for moving the same along the elevator mast, an overload-prevention means being provided.

2. Description of Related Art including information disclosed under 37 CFR 1.97

Building elevators of this type are known in principle. Such building elevators are used for transporting passengers or materials, the design of the elevator car differing in dependence on the carrying purpose. In particular in the case of building elevators for transporting passengers, an overload-prevention means is provided, i.e. it has to be ensured that the elevator is deactivated if the load which is to be transported exceeds a predetermined maximum value.

In the case of building elevators with an electric geared motor as the drive motor, it is known to allow the torque arm of said geared motor to act on a limit switch. With corresponding deflection of the torque arm of the geared motor as a result of overload, the overload-prevention means is then automatically actuated by the limit switch being triggered. This solution is suitable for building elevators with one electric motor as the drive. However, should a building elevator which can transport greater loads be equipped with two such drive motors, such an overload-prevention means is not suitable.

The object of the invention is to provide an overload-prevention means in the simplest manner possible for a building elevator with at least two drive motors.

BRIEF SUMMARY OF THE INVENTION

The object of the invention is to provide an overload-prevention means in the simplest manner possible for a building elevator with at least two drive motors.

The invention provides a solution which easily achieves an overload-prevention means even for building elevators with two or more drive motors. In this case, the forces occurring in the abutments of the motors are added and the resultant force is conducted to an adjustable limit switch. This arrangement thus achieves the situation where the forces from the motor drives are added and the exact load can thus be adjusted (by corresponding adjustment of the limit switch). If the permissible maximum load is exceeded, the elevator is correspondingly deactivated.

This overload-prevention means can be achieved particularly advantageously in design terms in that the drive motors are arranged one above the other and the device for adding the forces is formed by a rocker link which is arranged between the drive motors and is connected thereto. The resultant forces are then thus passed on to the limit switch via a rocker link.

Provision is particularly preferably made in design terms for the rocker link to be coupled in an articulated manner in each case to connecting members which are connected to the respective drive motor. This means that it is particularly simple for the two motors to be coupled to the common rocker link for the addition of the forces from the two motors.

Furthermore, provision is advantageously made, in a manner known per se, for it to be possible for the limit switch to be subjected to the action of the rocker link counter to the force of an adjustable spring.

A further advantageous configuration makes provision for the overload-prevention means to be designed such that it can be bypassed electrically. This provides the considerable additional advantage of avoiding the situation where, during travel, the limit switch could be triggered by oscillations.

BRIEF DESCRIPTION OF SEVERAL VIEWS OF THE DRAWING

The invention is explained in more detail hereinbelow by way of example with reference to the drawing, in which.

DETAILED DESCRIPTION OF THE INVENTION

Figure 1:
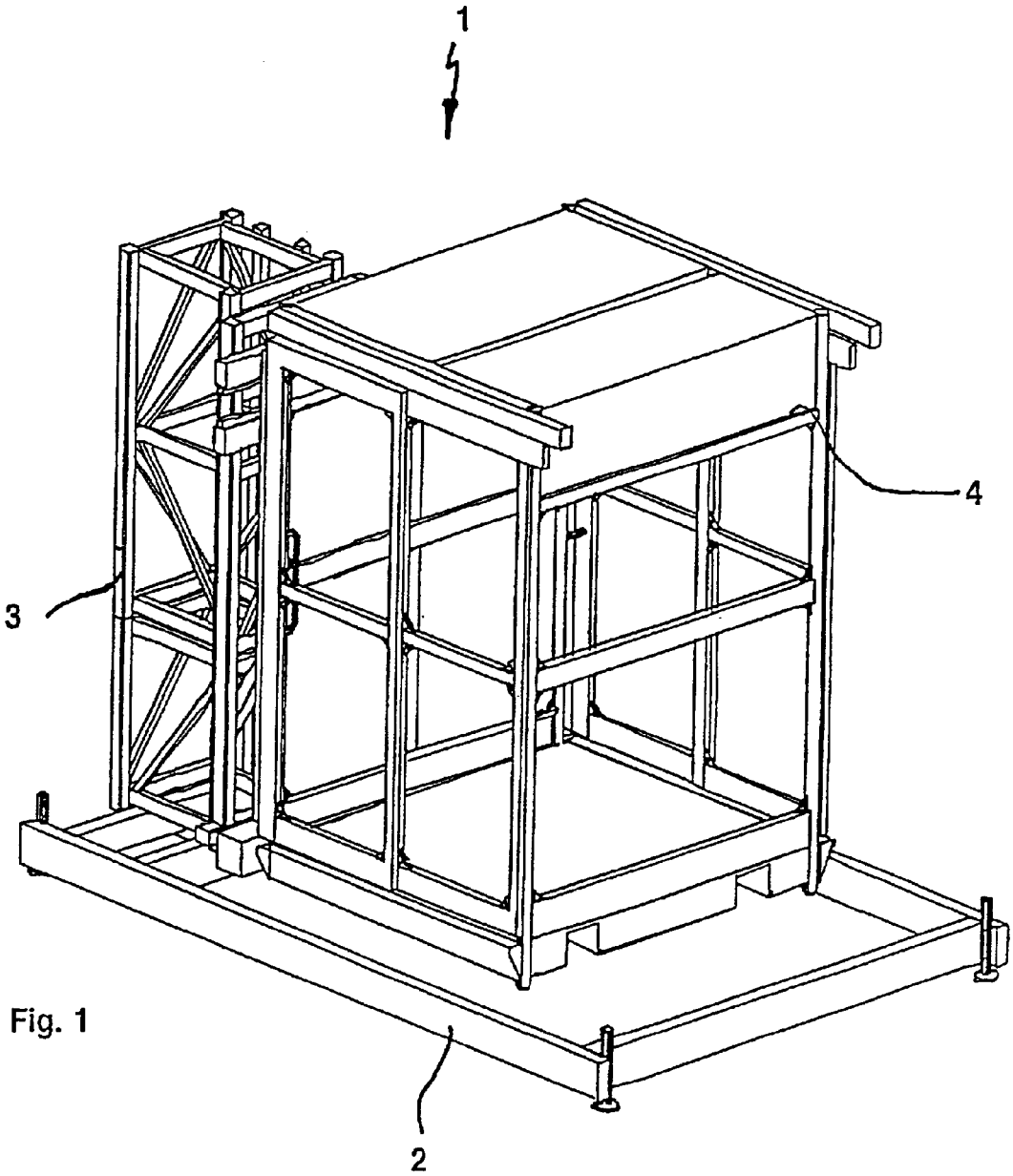
FIG. 1 shows a perspective illustration of a building elevator.

A building elevator is designated in general terms by 1 in FIG. 1. In the case of the exemplary embodiment illustrated, said building elevator has an elevator platform 2 which is to be anchored on a ground surface. Fastened on said elevator platform 2 is an elevator mast 3 which, depending on the use purpose, may have a variable vertical extent. Said elevator mast is equipped, inter alia, with a rack, which is not illustrated in FIG. 1. The elevator mast 3 serves for allowing the vertical movement of an elevator car, which is designated in general terms by 4.

Figure 2:
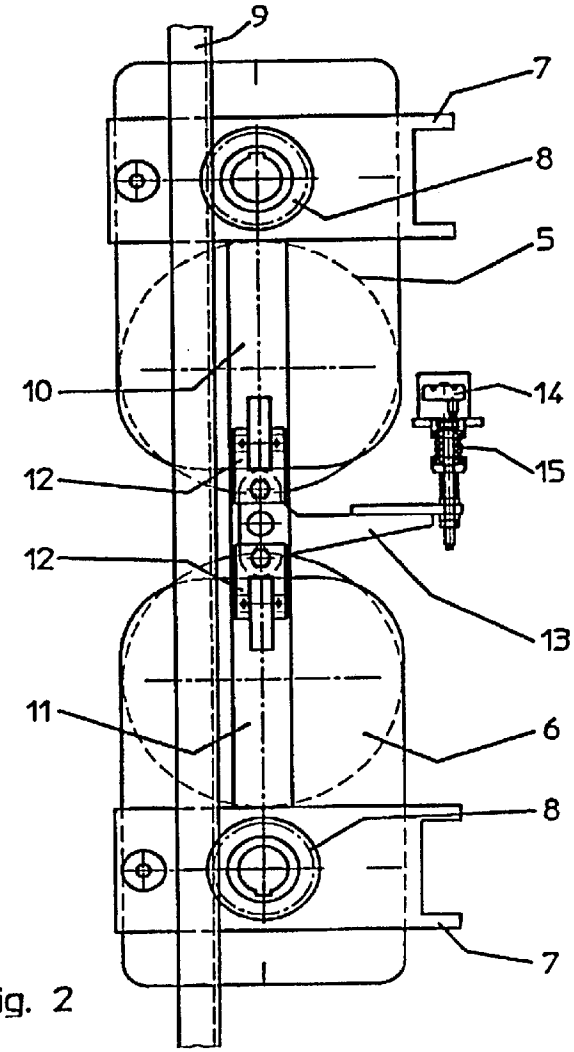
FIG. 2 shows the overload-prevention means according to the invention of the building elevator.
Figure 3:
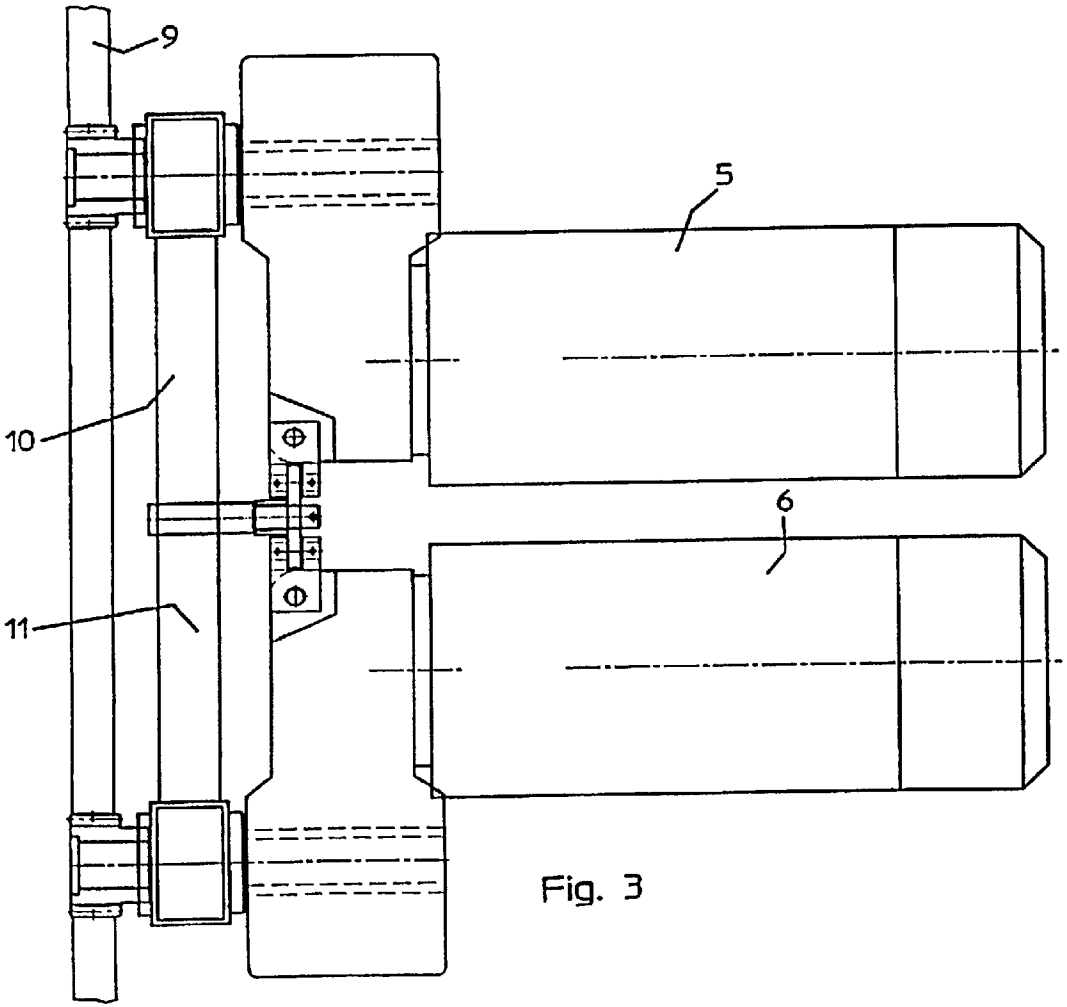
FIG. 3 shows a side view of the overload-prevention means according to FIG. 2.

For this purpose, in the case of the building elevator according to the invention, the elevator car 4 is equipped with two electric geared motors 5, 6 (FIG. 2) which are arranged one above the other and are each fastened on a fastening member 7 of the elevator car. Said geared motors 5, 6 each interact with the rack 9 of the elevator mast 3 via a gearwheel 8.

The two geared motors 5, 6 each have a connecting member 10, 11, and these are connected on the end sides in each case, via an articulation 12, to a common rocker link 13. This rocker link 13 essentially forms the overload-prevention means of the building elevator and is connected operatively on the end side to a limit switch 14, it being possible for the limit switch 14 to be adjusted by means of an adjustable cylindrical compression spring 15 such that triggering of the limit switch 14 by the rocker link 13 is only possible when the rocker link 13 is located in the position which corresponds to an overload deflection.

This arrangement of the two geared motors 5 and 6 and the connection via the rocker link 13 ensure that the forces from the two geared motors 5 and 6 are added and exact overload prevention is thus ensured. Of course, the limit switch 14 is connected to the control means of the building elevator in a suitable manner, which is known to a person skilled in the art and will thus not be explained in any more detail here.

In order to avoid triggering of the limit switch 14 on account of oscillations during travel, provision is made, although not illustrated in the drawing, for the limit switch 14 to be designed such that it can be bypassed electrically.

Of course, the invention is not restricted to the exemplary embodiment illustrated. Further configurations are possible without departing from the basic idea. Thus, of course, the overload-prevention means is suitable not just for the type of elevator illustrated in FIG. 1, but basically for all types of elevator with two drive motors arranged one above the other and the like.

What is claimed is:

1. A building elevator having an elevator mast and an elevator car cabin, said elevator mast having a rack and at least two drive motors being disposed one above the other on said elevator cabin;

each said drive motors having a pinion engaging into the rack to drive the cabin along said mast, with an overload safety apparatus being provided which has a device for totaling the forces arising in the counter-bearings of said drive motors; and said device is connected to an end switch.

2. The building elevator as claimed in claim 1, wherein the drive motors are arranged one above the other and the device for adding the forces is formed by a rocker link which is positioned between the drive motors and is connected to said drive motors.

3. The building elevator as claimed in claim 2, wherein the rocker link is coupled with an articulated means to each connecting members which are connected to the respective drive motor.

* * * * *